US006751929B1

(12) United States Patent
Sting et al.

(10) Patent No.: US 6,751,929 B1
(45) Date of Patent: Jun. 22, 2004

(54) DEVICE FOR HANDLING OBJECTS IN SHEET FORM

(75) Inventors: Martin Sting, Bad Vilbel (DE); Christian Botschek, Rodermark (DE)

(73) Assignee: Pitney Bowes Deutschland GmbH (DE)

( * ) Notice: Subject to any disclaimer, the term of this patent is extended or adjusted under 35 U.S.C. 154(b) by 0 days.

(21) Appl. No.: 09/700,534

(22) PCT Filed: Mar. 27, 2000

(86) PCT No.: PCT/EP00/02695

§ 371 (c)(1),
(2), (4) Date: Nov. 15, 2000

(87) PCT Pub. No.: WO00/58116

PCT Pub. Date: Oct. 5, 2000

(30) Foreign Application Priority Data

Mar. 25, 1999 (DE) ..... 199 13 637

(51) Int. Cl.[7] ..... B65B 1/04
(52) U.S. Cl. ..... 53/252; 53/284.3
(58) Field of Search ..... 53/284.3, 569, 53/460, 252, 381.5, 258; 221/272–275, 258

(56) References Cited

U.S. PATENT DOCUMENTS 3,802,446 A * 4/1974 Pilat ..... 453/62
4,079,576 A * 3/1978 Morrison et al. ..... 53/284.3
4,720,960 A * 1/1988 Green ..... 270/58.06
4,793,762 A * 12/1988 Munch et al. ..... 414/416.06
4,926,612 A 5/1990 Krasuski et al.
4,965,545 A * 10/1990 Johnson ..... 337/140
5,139,462 A * 8/1992 Gabe ..... 472/119
5,848,518 A 12/1998 Bufalini et al.
5,901,943 A * 5/1999 Tsunoda ..... 251/294
6,289,658 B1 * 9/2001 Sting et al. ..... 53/252

FOREIGN PATENT DOCUMENTS

WO WO 99/01295 1/1999

* cited by examiner

*Primary Examiner*—Rinaldi I. Rada
*Assistant Examiner*—John Paradiso
(74) *Attorney, Agent, or Firm*—Michael J. Cummings; Charles R. Malandra, Jr.; Angelo N. Chaclas

(57) ABSTRACT

In an apparatus for handling sheet-like articles, in particular in an envelope-filling station, in which a carrier (9) provided with push-in fingers (11) is moved back and forth by means of an actuating arrangement (12, 13, 14, 15, 16, 21, 26, 27, 28, 29, 31, 32) in order for articles which are conveyed up by means of a conveying path (2) to be received from the conveying path and handled in the conveying direction, improved adaptation of the handling speed of the push-in fingers (11) to the conveying speed of the conveying path (2) is achieved in that a drive mechanism (21, 26, 27, 28, 29, 31, 32) of the actuating arrangement contains a crank drive, on the crankshaft (28) of which there is fastened an elliptical two-belt pulley (29) which is coupled, via a toothed belt (31) to a continuously driven, round belt pulley (32).

2 Claims, 2 Drawing Sheets

DEVICE FOR HANDLING OBJECTS IN SHEET FORM

TECHNICAL FIELD

The invention relates to an apparatus for -handling sheet-like articles, in particular an envelope-filling station for mail-processing machines.

BACKGROUND ART

In the case of Known mail-processing machines, there is provided an elongate conveying path which may be formed by circulating conveying chains provided with conveying fingers, it being the case that, in the region of the top strand of the conveying chains, the conveying fingers project up beyond the surface of the conveying path and form there enclosure compartments which move intermittently or continuously and into which processing stations or handling apparatuses, which are lined up along the conveying path, introduce enclosures or sets of enclosures, which then run into an envelope-filling station at the end of the conveying path.

The individual handling apparatuses may contain gripper mechanisms which draw off individual enclosures from enclosure stacks and introduce them cyclically into the enclosure compartments of the conveying path. It is also possible, however, for the handling apparatuses to be transfer apparatuses which are supplied with enclosures or sets of enclosures from feed apparatuses which run transversely with respect to said conveying path and open out onto the latter.

Known envelope-filling stations contain an actuating arrangement having a drive-lever arrangement, which can be pivoted back and forth by a drive mechanism and is mounted pivotably above a base plate located on the level of the surface of the conveying path, and having a carrier hand, which is articulated on said drive-lever arrangement and on which in turn there are pivotably mounted, as handling elements, push-in fingers which have their outer ends spring-prestressed toward the base plate and are actuated by a guide control means such that they have their outer ends lowered onto the base plate in an operating stroke and raised from the base plate in a return-stroke movement.

Envelope-filling machines of traditional design contain, as drive-lever arrangement, a comparatively elongate drive lever which is mounted pivotably on the framework at a relatively large distance above the base plate and is assigned, as drive mechanism, a cam plate which acts on a lever attachment, provided with a cam-plate follow-on roller, and which is set in rotation by a drive shaft which extends parallel to the conveying path. The rotation of the cam plate is coordinated with the conveying cycle of the conveying path, such that when a set of documents is conveyed onto the base plate of the envelope-filling station from the conveying path, the drive lever begins its operating stroke and the push-in fingers grip the document stack and push it, transversely with respect to the conveying direction of the conveying path, into an envelope which is held open, and only then does the next conveying cycle of the conveying path begin. The length of the drive lever of said known envelope-filling station design makes it possible for the handling, that is to say for the envelope-filling operation, to achieve a sufficiently high push-in speed of the push-in fingers, with the result that the push-in operation can be completed reliably within a conveying cycle of the conveying path.

If however, for the purpose of reducing the installation height of an envelope-filling station disclosed, for example, in WO 99/01295, use is made of an actuating arrangement for the push-in fingers which is in the form of a three-link mechanism, it being the case that on a carrier hand, which has the push-in fingers at its front end and can be moved backward and forward at a certain distance above the base plate, there are articulated a drive-lever arrangement and a further link, the two extending upward to the framework-side bearing points, and the drive-lever arrangement can be pivoted back and forth by a crank drive mechanism, this achieves the situation where, in certain phases of the operating stroke of the push-in fingers, the speed of the free ends of the latter over the base plate is not sufficient in order to be able to be coordinated with the operating speed of the conveying fingers of the conveying path or, in the case of intermittent operation of the conveying path, with the cycle of the conveying fingers.

DISCLOSURE OF THE INVENTION

The invention is intended to achieve the object of configuring an apparatus which is intended for handling sheet-like articles and has the features of the preamble of claim 1 such that the advancement speed of the handling elements of the apparatus can be coordinated over a wider range with the advancement speed of an arrangement for feeding the sheet-like articles to said apparatus.

This object is achieved according to the invention by the features specified in claim 1. An advantageous configuration is characterized in claim 2.

BRIEF DESCRIPTION OF THE DRAWINGS

An exemplary embodiment is explained hereinbelow with reference to the drawing, in which.

DETAILED DESCRIPTION OF THE INVENTION

Figure 1:
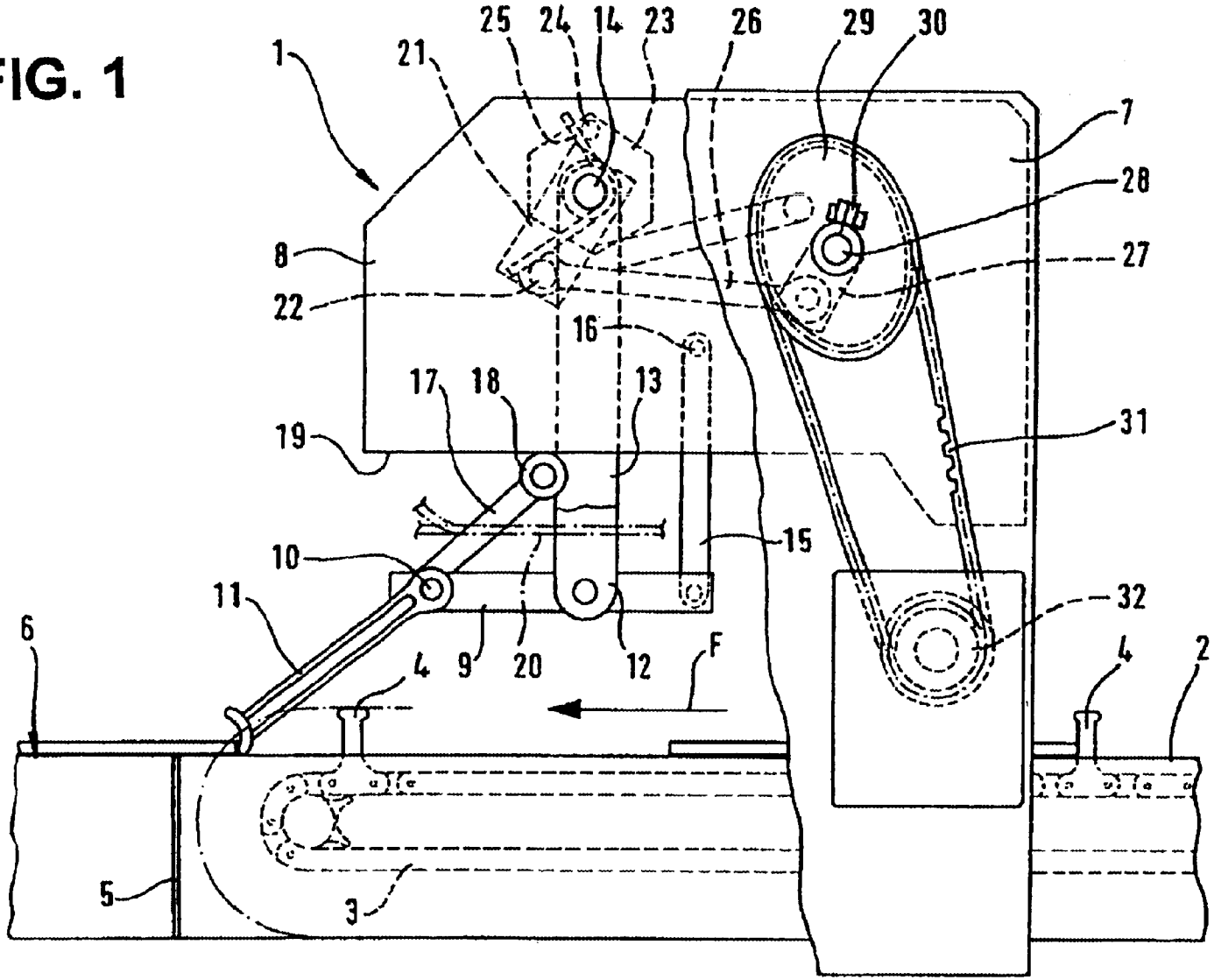
FIG. 1 shows a schematic, partially cut-away side view of an apparatus for handling sheet-like articles of the type specified here.

An apparats for handling sheet-like articles is designated by 1 in FIG. 1 and is assigned to an elongate conveying path 2 of a mail-processing system. The conveying path 2 contains mutually parallel, circulating conveying chains 3 which are arranged one beside the other, transversely with respect to the conveying direction F corresponding to the arrow, and are each provided, at certain intervals, with conveying fingers 4 which project upward, in the region of the top strand of the conveying chains 3, beyond the surface of the conveying path 2 and form there, as the conveying chains circulate, document compartments, which have documents introduced into them, and put together to form sets of documents, by feed arrangements (not illustrated in FIG. 1) which are lined up along the conveying path 2. The document compartments, defined by pairs of conveying fingers 4, can be moved intermittently, but in particular continuously, by the conveying chains 3 being driven correspondingly.

At the end of the conveying path 2, which is indicated at 5 in FIG. 1, the documents or document stacks are transferred, by the handling apparatus 1 specified here, from the document compartments to a further apparatus, which is indicated schematically at 6 and may be formed by a further conveying arrangement or a processing station. In particular, the apparatus 6 may be a station in which envelopes are fed and held open, with the result that the documents or sets of documents can be pushed, from the document compartments of the conveying path 2, into the envelopes by the handling apparatus 1.

The handling apparatus 1 contains vertical housing side walls 7, which are spaced apart transversely with respect to the conveying direction F corresponding to the arrow and of which the housing side part which is remote from the person looking at the drawing, on the far side of the conveying path 2, has been left out altogether from the illustration of FIG. 1 and the housing part 7 which is located on that side of the conveying path 2 which is directed toward the person looking at the drawing is shown only in part in the illustration of FIG. 1. The housing side parts 7 are connected to one another by a prismatic housing roof, which contains a number of bends. This housing roof is not shown in FIG. 1 either. Located between the housing parts 7, and parallel to them is a vertical housing intermediate wall 8, which is fastened on the abovementioned prismatic housing roof and bears bearings for drive shafts and spindles of an actuating arrangement.

In specific terms, the actuating arrangement of the handling apparatus 1 contains a carrier 9, at the leading end of which in relation to the conveying direction F corresponding to the arrow, there are located bearings for a push-in finger shaft 10 on which there are fastened push-in fingers 11, whose distance from one another, transversely with respect to the conveying direction F corresponding to the arrow, is greater than the corresponding distance between pairs of conveying fingers 4 on the conveying chains 3, with the result that the pair of push-in fingers 11 can be guided past a pair of conveying fingers 4 without obstruction even when the outer ends of the push-in fingers 11 are located in the position in which they are lowered onto the surface of the conveying path 2, this position being shown in FIG. 1. In this position, the push-in fingers 11 are prestressed by a helical spring which wraps around the push-in finger shaft 10 and is supported, on the one hand, against the push-in fingers 11 and, on the other hand, against the carrier 9.

In its central region, the carrier 9 is connected in an articulated manner to a drive-lever arrangement in the form of two drive levers 12 and 13. The drive levers 12 and 13 extend upward, from the point of articulation on the carrier 9, to a pivot spindle 14 which is connected fixedly to the drive levers 12 and 13 and is mounted rotatably in the housing intermediate wall 8 and one of the housing side parts 7.

Finally, connected to the rear end of the carrier 9 is a link 15 which extends upward from its point of articulation on the carrier 9 and is supported pivotably on the housing intermediate wall 8 at 16. The drive levers 12 and 13 are spaced apart by a certain distance in the direction transverse to the conveying direction F corresponding to the arrow and hold the carrier 9 between them, it being the case that the fastening location between the drive lever 13 and the pivot spindle 14 is located on that side of the housing intermediate wall 8 which is remote from the person looking at the drawing, while the fastening location between the drive lever 12 and the pivot spindle 14 is located on that side of the housing intermediate wall 8 which is directed toward the person looking at the drawing.

It should be pointed out that the carrier 9, the drive-lever pair 12, 13 and the link 15 form a three-lever mechanism which, as a result of the selection of the effective lever lengths and of the selection of the distances and the positions of the points of articulation on the carrier 9 and on the housing intermediate wall 8, result in the push-in finger shaft 10, during pivot movements of the drive levers 12 and 13, being moved parallel to itself, more or less in a horizontal plane, at a distance above the surface of the conveying path 2, in the conveying direction, and counter to the conveying direction F, corresponding to the arrow.

Fastened on the push-in finger shaft 10, in addition to the push-in fingers 11, is a guide contact lever 17 which is approximately diametrically opposite the push-in fingers and bears a guide contact roller 18 at its free end. As the carrier 9 moves in an operating stroke in the direction of the arrow, the guide contact roller 18 moves on the bottom border 19 of the housing intermediate wall 8, said bottom border being designed as a stationary guide part. During a return stroke of the carrier 9 counter to the direction of the arrow, the guide contact roller 18 runs on the guide path of a changeover guide part 20, said guide path being directed toward the surface of the conveying path 2, it being the case that in this case the guide contact lever 17 has been pivoted in the clockwise direction in relation to the position shown in FIG. 1 and has the effect of raising the bottom ends of the push-in fingers 11 from the surface of the conveying path 2. The changeover guide part 20 is configured in a diverter-like manner and is mounted pivotably on the housing intermediate wall 8. However, details in this respect are not important as far as understanding the present invention is concerned. All that need be said here is that the shape of the ends of the changeover guide part and prestressing means which act on the changeover guide part ensure that the guide contact roller can make a comparatively smooth transition from one guide onto the respective other guide at the ends of the operating stroke and of the return stroke.

An auxiliary drive lever 21 is mounted pivotably on the pivot spindle 14 on that side of the housing intermediate wall 8 which is remote from the person looking at the drawing. The auxiliary drive lever 21 is provided with a stop and bearing bolt 22, which runs parallel to the pivot spindle 14. Moreover, positioned on the pivot spindle 14, and fixedly connected thereto, is a spring bearing 23 with a spring stop bolt 24 oriented parallel to the pivot spindle 14. Wrapped around the pivot spindle 14 is a helical spring 25, of which the ends are supported, on the one hand, against the stop and bearing bolt 22 and, on the other hand, against the spring bearing bolt 24. Between the drive levers 12 and 13, connected to the pivot spindle 14 and thus to the spring bearing 23, on the one hand, and the auxiliary drive lever 21, on the other hand, the helical spring 25 produces a prestressing torque which holds the stop and bearing bolt 22 of the auxiliary drive lever 21 in abutment against a narrow side of the drive lever 13.

Moreover, a connecting rod 26 is connected to the auxiliary drive lever 21 via the stop and bearing bolt 22. The other end of the connecting rod 26 is connected to a crank 27, which is set in rotation by a crankshaft 28. The rotary movements of the crankshaft 28 produce, via the crank 27 and the connecting rod 26, corresponding pivot movements of the auxiliary drive lever 21 and thus of the drive levers 12 and 13.

In conjunction with the helical spring 25 and the spring bearing 23, positioned on the pivot spindle 14, the auxiliary drive lever 21 and its stop and bearing bolt 22, forming the point of articulation for the connecting rod 26 and the spring bearing for the helical spring 25, form an overload-prevention means such that, if the push-in fingers 11 and the carrier 9 are blocked, the crankshaft 28, the connecting rod 26 and the auxiliary drive lever 21 can execute their movements without the actuating arrangement being damaged.

On a section of the crankshaft 28 which extends beyond the bearing location of the corresponding housing side part 7, an elliptical toothed-belt pulley 29 is fastened and, as is indicated schematically at 30, can be adjusted in terms of its angle position relative to the crank 27. The elliptical toothed-belt pulley 29 is connected, via a toothed belt 31, to a driving toothed-belt pulley 32, which is coupled to an electric drive motor.

Drives with elliptical gear wheels or elliptical toothed-belt pulleys are known per se.

In the present example, driving the crankshaft 28 from a rotary drive at constant rotary speed, via the toothed belt 31 and the elliptical toothed-belt pulley 29, means that, even at high cycle speeds of operating stroke and return stroke of the carrier 9, there is no need for any cam or cam-plate control of these movements in order for the free ends of the push-in fingers 11 to pass the conveying fingers 4 of the conveying chains 3 briefly.

If one assumes a certain conveying speed of the conveying fingers 4 during that period of time in which the push-in fingers 11 are intended to receive documents or sets of documents, then the speed of the bottom ends of the push-in fingers 11, said ends gripping the documents or sets of documents, has to be greater than the speed of the conveying fingers at least during the transfer time period. This alone, however, is not sufficient for disruption-free transfer of documents or sets of documents from the conveying fingers 4 to the push-in fingers 11. This is because the latter have to be lowered behind a pair of conveying fingers 4, in relation to the conveying direction F corresponding to the arrow, and must then first of all catch up with the conveying fingers and subsequently pass them. During the passing movement, where the push-in finger ends raise a document or a set of documents from a conveying-finger pair 4, the speed of the push-in finger ends has to be sufficient to maintain a lead with respect to the conveying fingers, this lead allowing the outer ends of the conveying fingers 4, during circulation of the conveying chains 3, to lower beneath the surface of the conveying path 2, tilting forward toward the bottom strand of the conveying chains in the process, it being the case that the conveying fingers 4 must no longer grip the trailing edges of the documents or sets of documents which have just been raised. These movement speeds can be coordinated particularly well by the crank drive for the drive levers 12 and 13 in conjunction with the toothed-belt drive, containing the elliptical toothed-belt pulley 29. Even by the fact that the point of articulation of the connecting rod 26 of the crank drive on the auxiliary drive lever 21 is offset at an angle relative to the longitudinal axis of the drive levers 12 and 13, this results, at the end of the operating stroke of the carrier hand 9, in a higher speed in the direction of the arrow in comparison with the conditions when the connecting rod acts on the line connecting the start and end points of the drive levers 12 and 13, the latter case providing virtually a sinusoidal movement. An additional shift in the speed profile is achieved by the crankshaft 28 being driven via the elliptical toothed-belt pulley 29.

Figure 2:
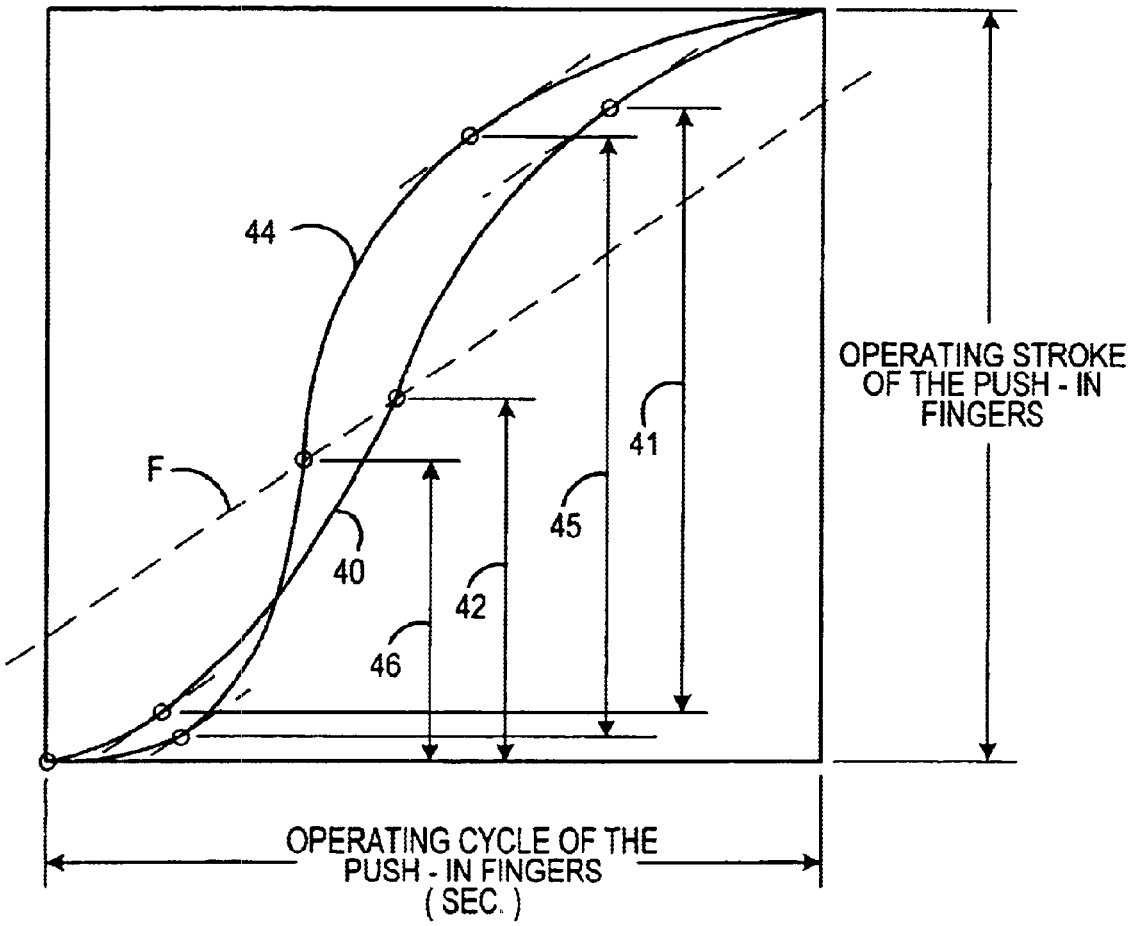
FIG. 2 shows a diagram in which the travel of the push-in fingers along the operating stroke is plotted against the operating cycle time of the push-in fingers.

The meaning of this shift in the speed profile over the operating cycle will be considered in more detail with reference to FIG. 2.

Let us assume an approximately constant length of the operating stroke for different designs of a push-in station, it being the case that this operating stroke is required in order to position the push-in fingers 11, by way of their bottom ends, on the surface of the conveying path 2 behind a pair of conveying fingers 4 in each case, to catch up the lead of the conveying fingers, with the latter remaining at a constant conveying speed, to raise from the relevant pair of conveying fingers 4 the set of enclosures pushed forward by the latter, and then to achieve a sufficient lead for the set of enclosures in relation to the conveying fingers 4, with the result that, at the end of the conveying chain, the conveying fingers can be lowered beneath the surface of the conveying path 2 without obstruction.

With a comparatively constant rotational speed of the crankshaft 28, said speed being coordinated with the conveying speed of the conveying chain, and without the use of an elliptical toothed-belt pulley, a comparatively long drive lever and directly articulated push-in fingers result in the bottom end of the latter, over the operating stroke, having, in first approximation, a sinusoidal advancement-speed profile corresponding to the curve 40 of FIG. 2. That section of the operating stroke in which the speed of the bottom ends of the push-in fingers exceeds the speed of the conveying fingers 4, corresponding to curve F, is designated by 41. The push-in fingers require a section 42 of the operating stroke from the beginning of the stroke in order to catch up the conveying fingers.

If, then, in the case of an apparatus of the type specified here, the rotary speed of the crankshaft 28 is modulated by the use of an elliptical toothed-belt pulley 29, then, with an actuating arrangement or a drive-lever arrangement for the push-in fingers, which in fact would result in a speed profile for the push-in fingers according to curve 40 of FIG. 2, it is possible, finally, to achieve a speed profile corresponding to the curve 44, such that, over a range 45 of the operating stroke, the bottom ends of the push-in fingers have a speed which exceeds the conveying speed of the conveying fingers 4. It can be seen that the range 45 is virtually as large as the range 41, which was assigned to the speed profile according to curve 40. However, the push-in fingers catch up the conveying fingers after just one operating-stroke section 46 in order to receive enclosures. Thereafter, they maintain a considerable lead in front of the conveying fingers, which can be lowered beneath the surface of the conveying path without obstruction.

It has been found that in particular the actuating arrangement of the embodiment according to FIG. 1 in the form of a three-link mechanism for the rectilinear guidance of the push-in finger shaft 10, in conjunction with the rotational-speed modulated drive of the crankshaft 28 via an elliptical toothed-belt pulley 29, results in smooth, disruption-free running, even at high operating speeds, and in easy adjustability of the apparatus for executing the operating phases as an enclosure or set of enclosures is received from the conveying fingers 4 by the bottom ends of the push-in fingers 11.

What is claimed is:

1. An apparatus for handling sheet-like articles, in particular enclosures in an envelope-filling station for mail-processing machines, having a conveying path (2), over which the sheet-like articles are conveyed in a state in which they rest on the conveying-path surface, having an actuating arrangement (12, 13, 14, 15, 16, 21, 26, 28, 29, 31, 32), which has a carrier (9) which, by means of a drive mechanism (21, 26, 28, 29, 31, 32) of the actuating arrangement, can be moved back and forth, parallel to the conveying direction, over the conveying-path surface such that at least part of the carrier (9) is guided approximately rectilinearly over the conveying-path surface, and having push-in fingers (11), which are articulated on the carrier and, in a guidecontrolled manner, are lowered onto the conveying-path surface in the operating stroke and are raised from the conveying-path surface in the return stroke, wherein the drive mechanism has a crankshaft (28), a crank (27) and a connecting rod (26) which, on the one hand, is mounted on the crank and, on the other hand, is in coupling connection with a drive lever (12, 13) of the actuating arrangement for the purpose of moving the carrier (9), and in that fastened on the crankshaft (28) is an elliptical toothed-belt pulley (29) which is coupled, via a toothed belt (31), to a continuously driven, round toothed-belt drive pulley (32).

2. The apparatus as claimed in claim 1, wherein the actuating arrangement has, as carrier, a carrier hand, at the front end of which, as seen in the conveying direction (F), there is mounted a push-in finger shaft (10), bearing the push-in fingers (11), and which, between its ends, is connected to a drive-lever arrangement (12, 13), mounted pivotably on the framework at its top end, and which, at its rear end, is connected to a link (15), likewise mounted on the framework at its top end, it being the case that the carrier hand, the drive-lever arrangement (12, 13) and the link (15) form a three-link rectilinear-guidance mechanism for the purpose of moving the push-in finger shaft (10) parallel to itself and to the conveying-path surface in the conveying direction (F).

* * * * *